US011265975B2

(12) United States Patent
Jang et al.

(10) Patent No.: US 11,265,975 B2
(45) Date of Patent: Mar. 1, 2022

(54) INDUCTION HEATING DEVICE AND METHOD FOR CONTROLLING THE SAME

(71) Applicant: LG ELECTRONICS INC., Seoul (KR)

(72) Inventors: Ho Yong Jang, Seoul (KR); Byeong Geuk Kang, Seoul (KR); Jea Shik Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 140 days.

(21) Appl. No.: 16/018,225

(22) Filed: Jun. 26, 2018

(65) Prior Publication Data

US 2018/0376546 A1 Dec. 27, 2018

(30) Foreign Application Priority Data

Jun. 26, 2017 (KR) ..... 10-2017-0080804

(51) Int. Cl.
*H05B 6/12* (2006.01)
*H05B 6/06* (2006.01)
*F24C 9/00* (2006.01)

(52) U.S. Cl.
CPC ..... *H05B 6/1245* (2013.01); *H05B 6/062* (2013.01); *H05B 6/1218* (2013.01); *F24C 9/00* (2013.01);
(Continued)

(58) Field of Classification Search
CPC ..... H05B 2213/05; H05B 2213/07; H05B 6/062; H05B 6/1218; H05B 6/1245;
(Continued)

(56) References Cited

U.S. PATENT DOCUMENTS

2007/0125768 A1 6/2007 Kim et al.
2010/0282740 A1 11/2010 Artigas Maestre et al.
(Continued)

FOREIGN PATENT DOCUMENTS

DE 11 2013 007 531 7/2016
EP 1 793 653 6/2007
(Continued)

OTHER PUBLICATIONS

European Search Report dated Nov. 20, 2018 issued in EP Application No. 18179803.4.
(Continued)

*Primary Examiner* — Dana Ross
*Assistant Examiner* — Joe E Mills, Jr.
(74) *Attorney, Agent, or Firm* — Ked & Associates, LLP

(57) ABSTRACT

The present disclosure relates to an induction heating device and a method for controlling the same. In accordance with the present disclosure, first, inductive sensing is periodically performed to detect a specific object with inductive heating property. Next, current sensing of the specific object having the inductive heating property is performed to again check whether the specific object has the inductive heating property. Thus, when the user simply places the loaded object on the device, the device may allow the user to quickly and intuitively confirm whether the corresponding loaded object has the inductive heating property.

19 Claims, 9 Drawing Sheets

(52) U.S. Cl.
CPC .... *H05B 2206/022* (2013.01); *H05B 2213/05* (2013.01); *H05B 2213/07* (2013.01)

(58) Field of Classification Search
CPC ..... H05B 6/1209; H05B 6/365; H05B 2206/022; F24C 9/00
See application file for complete search history.

(56) References Cited

U.S. PATENT DOCUMENTS

| | | | | |
|---|---|---|---|---|
| 2012/0255946 | A1 | 10/2012 | Kim et al. | |
| 2015/0341990 | A1* | 11/2015 | Nagata | H05B 6/062 219/622 |
| 2015/0357893 | A1* | 12/2015 | Deak, Sr. | H02K 35/06 310/38 |
| 2016/0150600 | A1 | 5/2016 | Lomp et al. | |
| 2016/0262213 | A1* | 9/2016 | Blasco Rueda | H05B 6/062 |
| 2018/0025838 | A1* | 1/2018 | Som | H02J 50/10 361/143 |

FOREIGN PATENT DOCUMENTS

| | | |
|---|---|---|
| EP | 2 509 392 | 10/2012 |
| EP | 2642820 | 9/2013 |
| EP | 2914058 | 9/2015 |
| EP | 3 026 981 | 6/2016 |
| JP | 2589159 | 1/1999 |
| JP | 6038345 | 12/2016 |
| WO | WO 2009/090152 | 7/2009 |
| WO | WO 2014/064941 | 9/2016 |

OTHER PUBLICATIONS

Korean Office Action dated Apr. 3, 2019 issued in Application No. 10-2017-0080804.

European Search Report dated Jul. 27, 2021 issued in Application No. 21171142.9.

* cited by examiner

INDUCTION HEATING DEVICE AND METHOD FOR CONTROLLING THE SAME

CROSS-REFERENCE TO RELATED APPLICATION

This application claims priority under 35 U.S.C. § 119 to Korean Application No. 10-2017-0080804, filed on Jun. 26, 2017, whose entire disclosure is hereby incorporated by reference.

BACKGROUND

1. Field

The present disclosure relates to an induction heating device and a method for controlling the same.

2. Background

In homes and restaurants, cooking appliances may use various heating methods to heat a cooking vessel, such as a pot. Gas ranges, stoves, or other cookers may use synthetic gas (syngas), natural gas, propane, butane, liquefied petroleum gas or other flammable gas as a fuel source. Other types of cooking devices may heat a cooking vessel using electricity.

Cooking devices using electricity-based heating may be generally categorized as resistive-type heating devices or inductive-type heating devices. In the electrical resistive heating devices, heat may be generated when current flows through a metal resistance wire or a non-metallic heating element, such as silicon carbide, and this heat from the heated element may be transmitted to an object through radiation or conduction to heat the object. As described in greater detail below, the inductive heating devices may apply a high-frequency power of a predetermined magnitude to a working coil, such as a copper coil, to generate a magnetic field around the working coil, and magnetic induction from the magnetic field may cause an eddy current to be generated in an adjacent pot made of a certain metals so that the pot itself may be heated due to electrical resistance from the eddy current.

In greater detail, the principles of the induction heating scheme includes applying a high-frequency voltage (e.g., an alternating current) of a predetermined magnitude to the working coil. Accordingly, an inductive magnetic field may be generated around the working coil. When a pot containing certain metals or other inductive metals is positioned on or near the working coil to receive the flux of the generated inductive magnetic field, an eddy current may be generated inside the bottom of the pot. As the resulting eddy current flows within the bottom of the pot, the pot itself may be heated while the induction heating device remains relatively cool.

In this way, activation of the inductively-heated device causes the pot and not the loading plate of the inductively-heated device to be heated. When the pot is lifted or otherwise removed from the loading plate of the induction heating device and away from the inductive magnetic field around the coil, the pot ceases to be additionally heated since the eddy current is no longer being generated. Since the working coil in the induction heating device is not heated, the temperature of the loading plate remains at a relatively low temperature even during cooking, and the loading plate remains relatively safe to contact by a user. Also, by remaining relatively cool, the loading plate is easy to clean since spilled food items will not burn on the cool loading plate.

Furthermore, since the induction heating device heats only the pot itself by inductive heating and does not heat the loading plate or other component of the induction heating device, the induction heating device is advantageously more energy-efficient in comparison to the gas-range or the resistance heating electrical device. Another advantage of an inductively-heated device is that it heats pots relatively faster than other types of heating devices, and the pot may be heated on the induction heating device at a speed that directly varies based on the applied magnitude of the induction heating device, such that the amount and speed of the induction heating may be carefully controlled through control of the applied magnitude.

However, only pots including certain types of materials, such as ferric metals, may be used on the induction heating device. As previously described, only a pot or other object in which the eddy current is generated when positioned near the magnetic field from the working coil may be used on the induction heating device. Because of this constraint, it may be helpful to consumers for the induction heater to accurately determine whether a pot or other object placed on the induction heating device may be heated via the magnetic induction.

In certain induction heating devices, a predetermined amount of power may be supplied to the working coil for a predetermined time, to determine whether the eddy current occurs in the pot. The induction heating devices may then determine, based on whether the eddy current occurs in the pot, whether the pot is suitable for induction heating. However, according to this method, relatively high levels of power (for example, 200 W or more) may be used to determine the suitability of the pot for induction heating. Accordingly, an improved induction heating device could accurately and quickly determine whether a pot is compatible with induction heating while consuming.

BRIEF DESCRIPTION OF THE DRAWINGS

The embodiments will be described in detail with reference to the following drawings in which like reference numerals refer to like elements wherein.

DETAILED DESCRIPTION

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Figure 1:
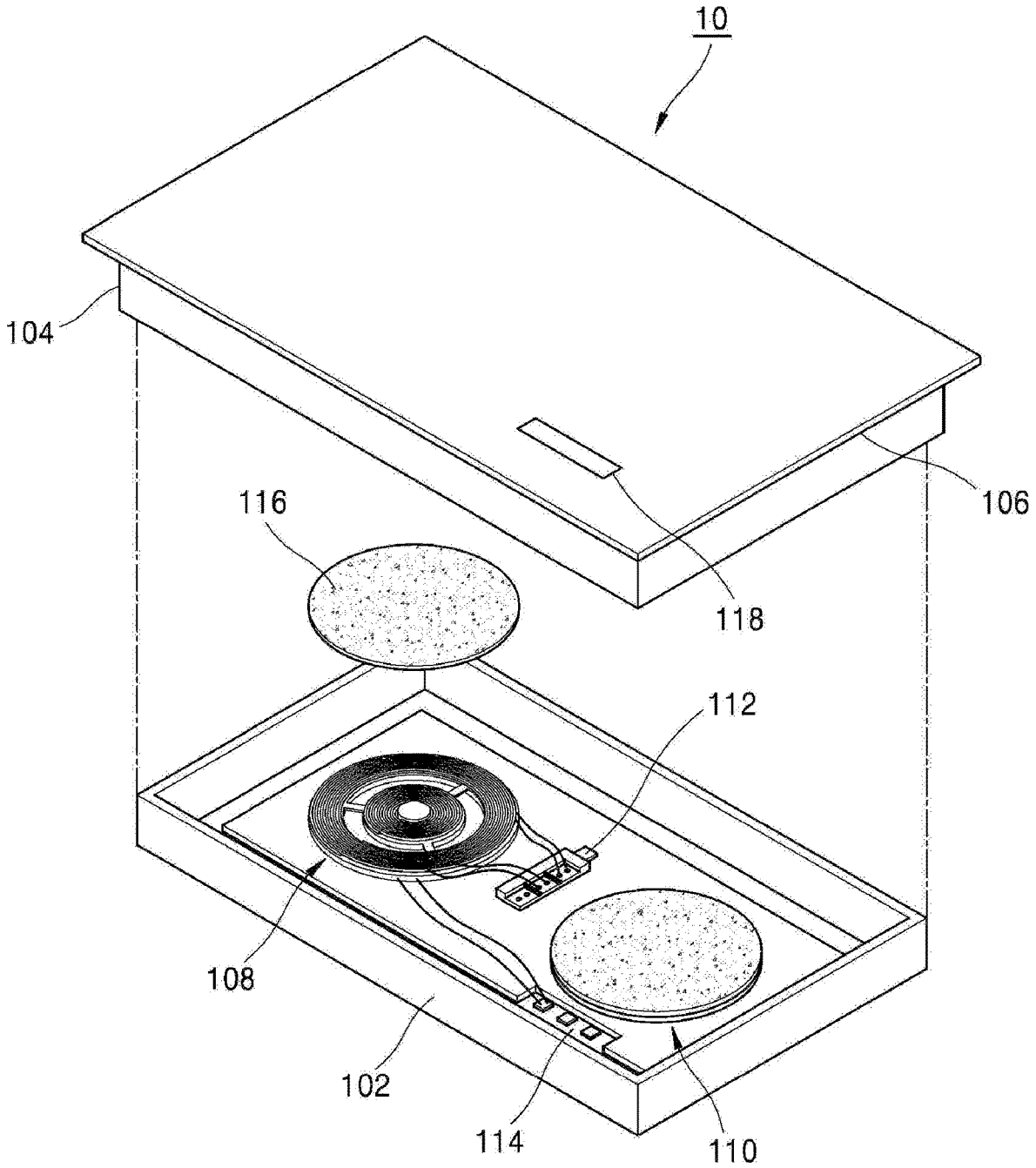
FIG. 1 is a schematic representation of an inductively-heated device according to one embodiment of the present disclosure.

FIG. 1 is a schematic representation of an inductively-heated device 10 according to one embodiment of the present disclosure. Referring to FIG. 1, an induction heating device (also referred to as an induction stove or induction hob) 10 according to one embodiment of the present disclosure may include a casing 102 constituting a main body or outer appearance of the induction heating device 10, and a cover plate 104 coupled to the casing 102 to seal the casing 102.

The cover plate 104 may be coupled to a top face of the casing 102 to seal a space defined inside the casing 102 from the outside. The cover plate 104 may include a loading plate 106 on which a user may selectively place an object to be heated through inductive magnetic flux. As used herein, the phrase "loaded object" generally refers to a cooking vessel, such as pan or pot, positioned on the loading plate 106. In one embodiment of the present disclosure, the loading plate 106 may be made of a tempered glass material, such as ceramic glass.

Referring again to FIG. 1, one or more working coil assemblies (or working coils) 108, 110 to heat the loaded object may be provided in a space formed inside the casing 102. Furthermore, the interior of the casing 102 may also include an interface 114 that allows a user to control the induction heating device 10 to apply power, allows the user to control the output of the working coil assembles 108 and 110, and that displays information related to a status of the induction heating device 10. The interface 114 may include a touch panel capable of both information display and information input via touch. However, the present disclosure is not limited thereto, and depending on the embodiment, an interface 114 may include a keyboard, trackball, joystick, buttons, switches, knobs, dials, or other different input devices to receive a user input may be used. Furthermore, the interface 114 may include one or more sensors, such as a microphone to detect audio input by the user and/or a camera to detect motions by the user, and a processor to interpret the captured sensor data to identify the user input.

Furthermore, the loading plate 106 may include a manipulation region (or interface cover) 118 provided at a position corresponding to the interface 114. To direct input by the user, the manipulation region 118 may be pre-printed with characters, images, or the like. The user may perform a desired manipulation by touching a specific point in the manipulation region 118 corresponding to the preprinted character or image. Further, the information output by the interface 114 may be displayed through the loading plate 106.

Further, in the space formed inside the casing 102, a power supply 112 to supply power to the working coil assemblies 108,110 and/or the interface 114 may be provided. For example, the power supply 112 may be coupled to a commercial power supply and may include one or more components that convert the commercial power for use by the working coil assemblies 108,110 and/or the interface 114.

In the embodiment of FIG. 1, the two working coil assemblies 108 and 110 are shown inside the casing 102. It should be appreciated, however, that the induction heating device 10 may include any number of working coil assemblies 108, 110. For example, in other embodiments of the present disclosure, the induction heating device 10 may include one working coil assembly 108 or 110 within the casing 102, or may include three or more working coil assemblies 108, 110.

Each of the working coil assemblies 108 and 110 may include a working coil that generates an inductive magnetic field using a high frequency alternating current supplied thereto by a power supply 112, and a thermal insulating sheet 116 to protect the working coil from heat generated by the loaded object on the cover plate. In certain embodiments of the induction heating device 10, the thermal insulating sheet 116 may be omitted.

Although not shown in FIG. 1, a control unit (such as control unit 602 in FIG. 6), also referred to herein as a controller or processor, may be provided in the space formed inside the casing 102. The control unit may receive a user command via the interface 114 and may control the power supply 112 to activate or deactivate the power supply to the working coil assembly 108, 110 based on the user command.

Figure 2:
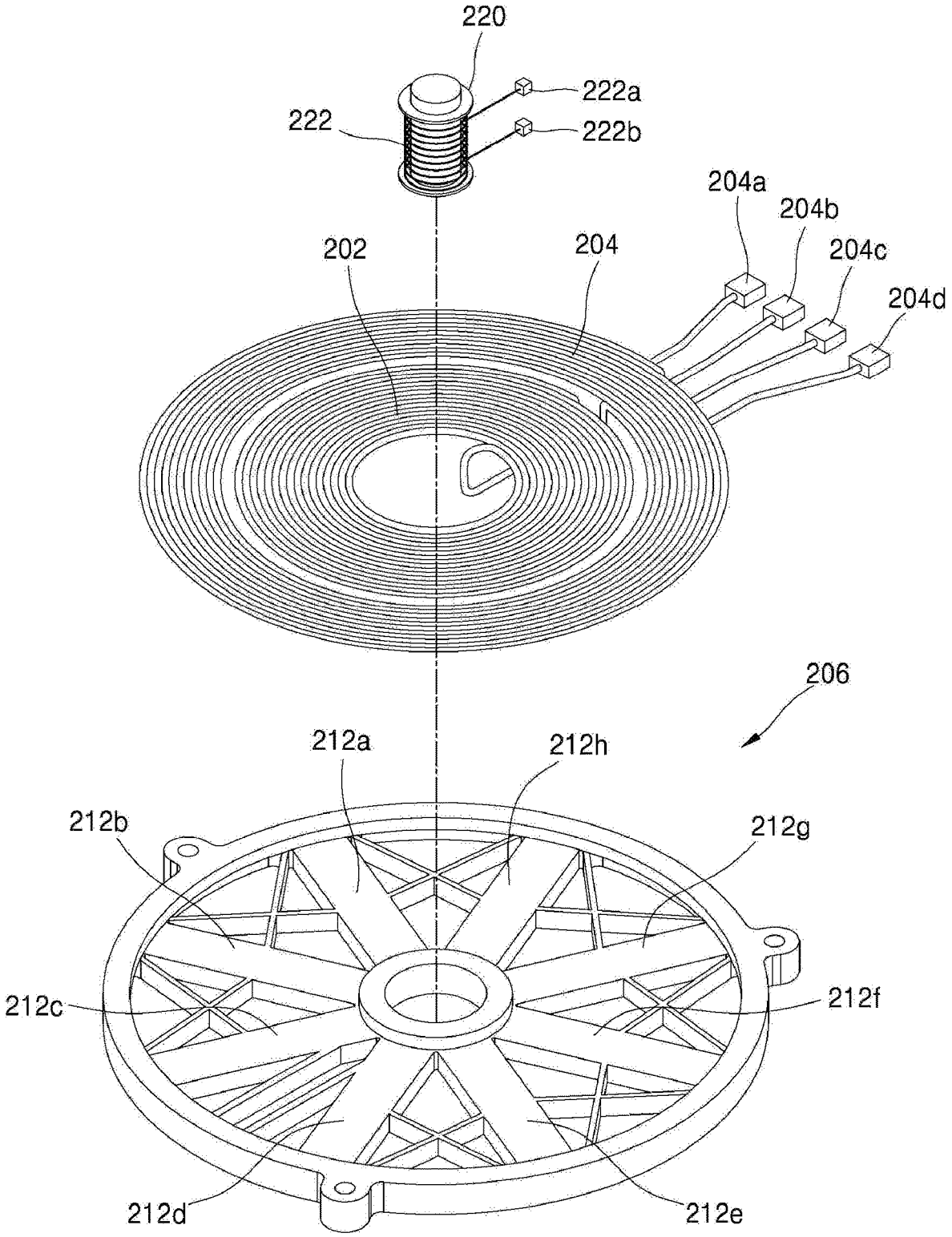
FIG. 2 is a perspective view showing a structure of a working coil assembly included in an induction heating device according to one embodiment of the present disclosure.
Figure 3:
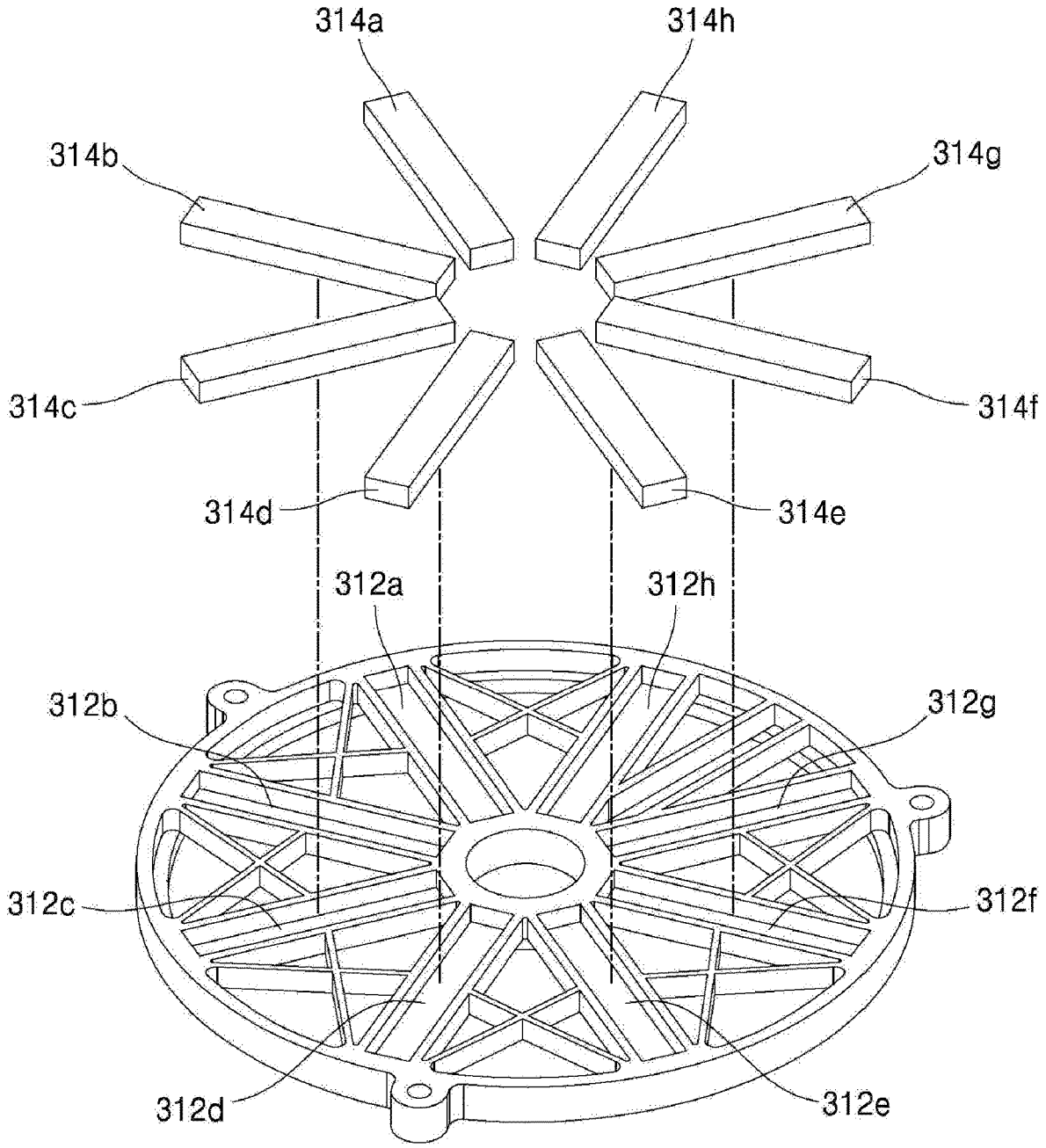
FIG. 3 is a perspective view showing a coil base included in the working coil assembly according to one embodiment of the present disclosure.

Hereinafter, with reference to FIGS. 2 and 3, a structure of the working coil assembly 108, 110 included in the inductively-heated device 10 according to embodiment will be described in detail. For example, FIG. 2 provides a perspective view showing a structure of a working coil assembly included in an induction heating device, and FIG. 3 is a perspective view showing a coil base included in the working coil assembly.

The working coil assembly according to one embodiment of the present disclosure may include a first working coil 202, a second working coil 204, and a coil base 206. The first working coil 202 may be mounted on the coil base 206 and may be wound circularly a first number of times (e.g., a first rotation count) in a radial direction. Furthermore, a second working coil 204 may be mounted on the coil base 206 and may be circularly wound around the first working coil 202 a second number of times (e.g., a second rotation count) in the radial direction. Thus, the first working coil 202 may be located radially inside and at a center of the second working coil 204.

The first rotation count of the first working coil 202 and the second rotation count of the second working coil 204 may vary according to the embodiment. The sum of the first rotation count of the first working coil 202 and the second rotation count of the second working coil 204 may be limited by the size of the coil base 206, and the configuration of the induction heating device 10 and the wireless power transmission device.

Both ends of the first working coil 202 and both ends of the second working coil 204 may extend outside the first working coil 202 and the second working coil 204, respectively. Connectors 204*a* and 204*b* may be respectively connected to the two ends of the first working coil 202, while connectors 204*c* and 204*d* may be connected to the two ends of the second working coil 204, respectively. The first working coil 202 and the second working coil 204 may be electrically connected to the control unit (such as control unit 602) or the power supply (such as power supply 112) via the connectors 204*a*, 204*b*, 204*c* and 204*d*. According to an embodiment, each of the connectors 204*a*, 204*b*, 204*c*, and 204*d* may be implemented as a conductive connection terminal.

The coil base 206 may be a structure to accommodate and support the first working coil 202 and the second working coil 204. The coil base 206 may be made of or include a nonconductive material. In the region of the coil base 206 where the first working coil 202 and the second working coil 204 are mounted, receptacles 212*a* to 212*h* may be formed in a lower portion of the coil base 206 to receive magnetic sheets, such as ferrite sheets 314*a*-314*h* described below.

As shown in FIG. 3, the receptacles 312*a* to 312*h* (corresponding to receptacles 212*a* to 212*h* in FIG. 2) may be formed at lower portions of the coil base 206 to receive and accommodate the ferrite sheets 314*a* to 314*h*. The receptacles 312*a* to 312*h* may extend in the radial direction of the first working coil 202 and the second working coil 204. The ferrite sheets 314*a* to 314*h* may extend in the radial direction of the first working coil 202 and the second working coil 204. In should be appreciated that the number, shape, position, and cross-sectional area of the ferrites sheet 314*a* to 314*h* may vary in different embodiments. Furthermore, although the ferrites sheet 314*a* to 314*h* although designed as "ferrite" may include various non-ferrous materials.

As shown in FIG. 2 and FIG. 3, the first working coil 202 and the second working coil 204 may be mounted on the coil base 206. A magnetic sheet may be mounted under the first working coil 202 and the second working coil 204. This magnetic sheet may prevent the flux generated by the first working coil 202 and the second working coil 204 from being directed below the coil base 206. Preventing the flux from being directed below the coil base 206 may increase a density of the flux produced by the first working coil 202 and the second working coil 204 toward the loaded object.

Meanwhile, as shown in FIG. 2, a loaded-object sensor 220 according to one embodiment of the present disclosure may be provided in the central region of the first working coil 202. In the embodiment of FIG. 2, the loaded-object sensor 220 may be provided concentrically with the first working coil 202, but the present disclosure is not limited thereto. Depending on the embodiment, the position of the loaded-object sensor 220 may vary.

On the outer face of the loaded-object sensor 220, a sensing coil 222 may be wound by a predetermined rotation count. Both ends of the sensing coil 222 may be connected to connectors 222*a* and 222*b*, respectively. The sensing coil 222 may be electrically connected to the control unit (such as control unit 602) or a power supply (such as power supply 112) via the connectors 222*a* and 222*b*. The control unit may manage the power supply to supply current to the sensing coil 222 through the connectors 222*a* and 222*b* of the loaded-object sensor 220 to determine the type of the loaded object, as described below.

Figure 4:
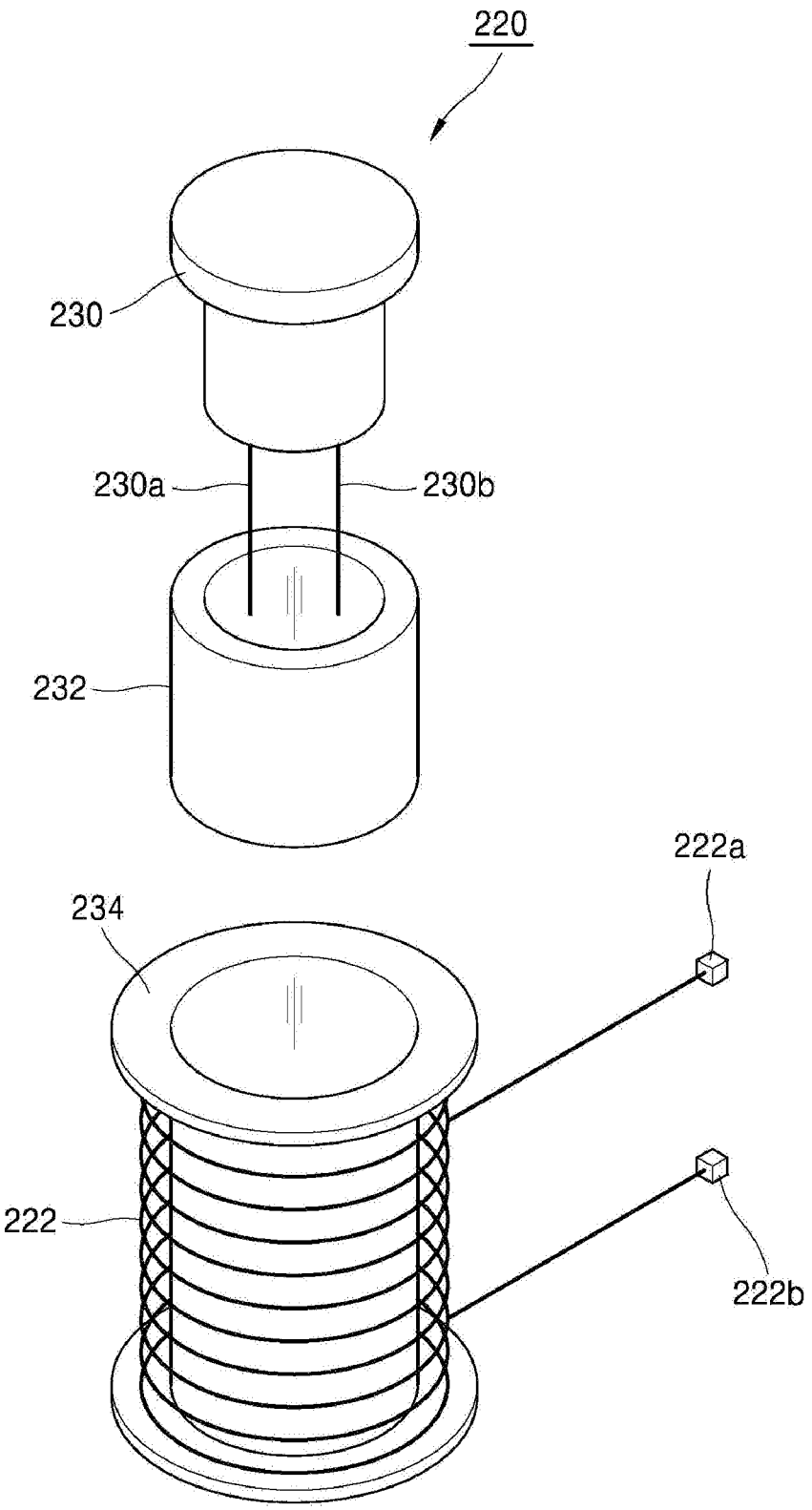
FIG. 4 shows a configuration of a loaded-object sensor according to one embodiment of the present disclosure.

FIG. 4 shows a configuration of a loaded-object sensor 220 according to one embodiment of the present disclosure. Referring to FIG. 4, the loaded-object sensor 220 according to one embodiment of the present disclosure may include a cylindrical hollow body 234. The space formed inside the cylindrical hollow body 234 may be defined as a first receiving space.

A sensing coil 222 may be wound by a predetermined winding count around an outer surface of the cylindrical hollow body 234. Both ends of the sensing coil 222 may be connected to connectors 222*a* and 222*b* for electrical connection with other devices. The sensing coil 222 may be electrically connected to a control unit (such as control unit 602) and/or a power supply (such as power supply 112) via the connectors 222*a* and 222*b*.

In one embodiment of the present disclosure, the control unit (such as control unit 602) may determine a type or other attribute of the loaded object. For example, the control unit may determine whether or not the loaded object is suitable for induction heating based on, for example, the change in the inductance value or current phase of the sensing coil 222 when the current is applied to the sensing coil 222 through the power supply.

Furthermore, the loaded-object sensor 220 may include a magnetic core 232 that may be received in the first receiving space of the cylindrical hollow body 234 and may have a substantially cylindrical shape. The magnetic core 232 may be made of or otherwise include a material characterized by magnetism, such as ferrite. The magnetic core 232 may increase the density of flux induced in the sensing coil 222 when a current flows through the sensing coil 222. The magnetic core 232 may have a hollow substantially cylindrical shape that includes a second receiving space defined therein.

Within the second receiving space of the magnetic core 232, a temperature sensor 230 may be received. The temperature sensor 230 may be a sensor that measures a temperature of the loaded object. The temperature sensor 230 may include wires 230*a* and 230*b* to provide an electrical connection with other devices, such as to a control unit or a power supply. The wires 230*a* and 230*b* of the temperature sensor 230 may be extend to pass to the outside through an opposite side of the magnetic core 232 and the other side of the cylindrical hollow body 234 through the first and second receiving spaces.

Figure 5:
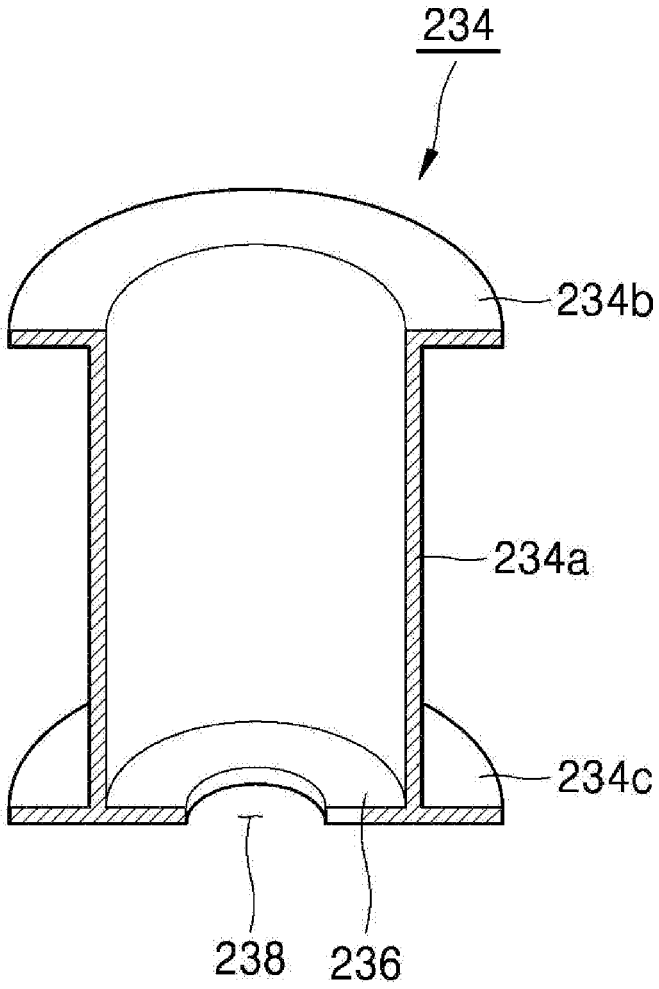
FIG. 5 is a vertical cross-sectional view of a body included in a loaded-object sensor according to one embodiment of the present disclosure.

FIG. 5 is a longitudinal section of the cylindrical hollow body 234 of the loaded-object sensor 220 according to one embodiment of the present disclosure. As shown in FIG. 5, the cylindrical hollow body 234 of the loaded-object sensor 220 may have a cylindrical hollow vertical portion (or cylindrical wall) 234*a*, a first flange 234*b* extending horizontally from the top of the vertical portion 234*a* (or a first axial end adjacent to the loading plate 106), and a second flange 234*c* extending from the bottom of the vertical portion 234*a* (or a second axial end opposite to the loading plate 106).

The first flange 234*b* may extend along the outer face of the upper end of the vertical portion 234*a* so that the magnetic core 232 may be freely moved downward into the first receiving space of the cylindrical hollow body 234. Further, the second flange 234*c* may include a support portion 236 (or internal flange) to support the magnetic core 232 and block further downward motion of the magnetic core 232 when the magnetic core 232 is received into the first receiving space within the cylindrical hollow body 234.

Further, a hole 238 that provides a through passage for the wires 230*a* and 230*b* of the temperature sensor 230 may be defined in the supporting portion 236 of the second flange 234*c*. The wires 230*a* and 230*b* of the temperature sensor may pass through the bottom of the magnetic core 232 and though the hole 238 to extend out of the cylindrical hollow body 234. The wires 230*a* and 230*b* of the temperature sensor 230 that are exposed through the hole 238 may be electrically connected to the control unit (such as control unit 602) or the power supply (such as the power supply 112).

In FIG. 4 and FIG. 5, the temperature sensor 230 and the magnetic core 232 may be vertically inserted in the direction from the first flange 234*b* toward the second flange 234*c* (e.g., downward). However, in another embodiment of the present disclosure, the temperature sensor 230 and the magnetic core 232 may be inserted in a direction upward through the second flange 234*c* and toward the first flange 234*b*. In this configuration, the support portion 236 having the wire hole 238 defined therein may be included in the first flange 234*b*.

As described with reference to FIGS. 4 and 5, the loaded-object sensor 220 according to the present disclosure may determine a type or other attribute of the loaded object using the current flowing in the sensing coil 222, and at the same time, the temperature of the loaded object may be measured using the temperature sensor 230. Because the temperature sensor 230 may be received within the cylindrical hollow body 234, the overall size and volume of the sensor may be reduced, making placement and space utilization thereof within the inductively-heated device more flexible.

Figure 6:
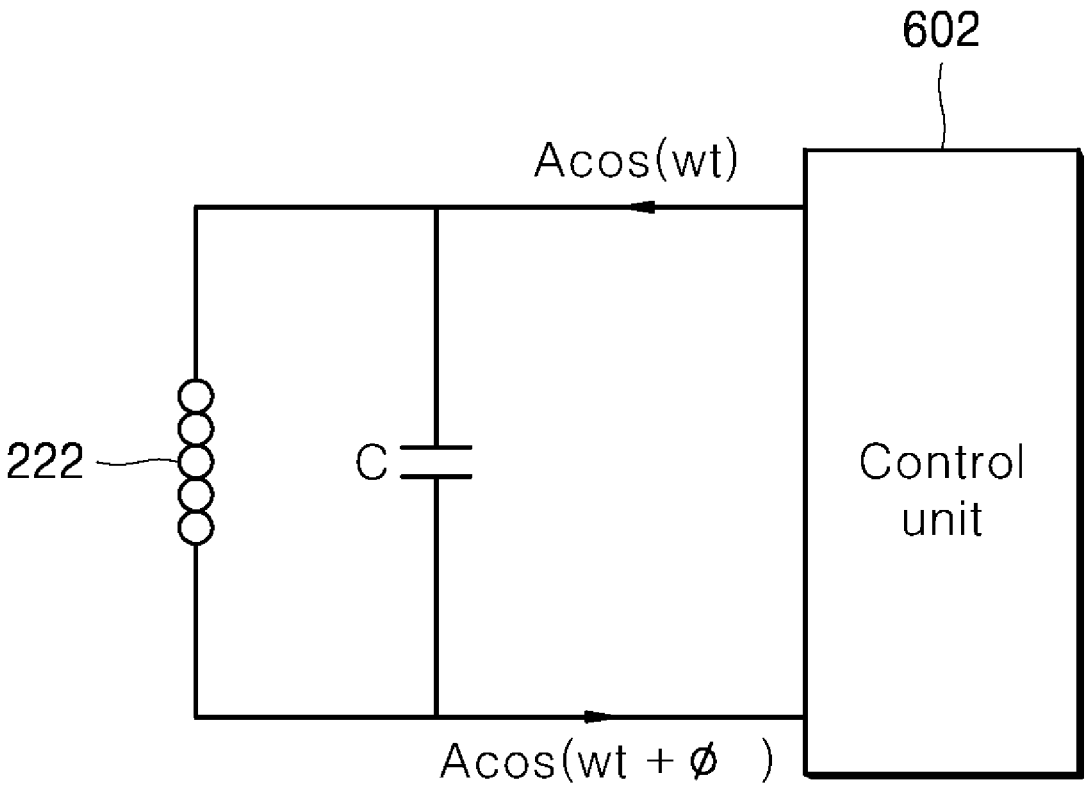
FIG. 6 is a circuit diagram illustrating an inductive sensing process using a loaded-object sensor in one embodiment of the present disclosure.

FIG. 6 is a circuit diagram illustrating an inductive sensing process using a loaded-object sensor 220 in one embodiment of the present disclosure. Referring to FIG. 6, a control unit 602 (or controller) according to the present disclosure may manage a power supply (such as power supply 112) to apply an alternating current A cos(ωt) having a predetermined amplitude A and phase value ωt to the sensing coil 222 of the loaded-object sensor 220. After applying the alternating current to the sensing coil 222, the control unit 602 may include a sensor to receive the alternating current through the sensing coil 222 and to analyze the components of the received alternating current to determine changes in the attributes of the alternating current, such a phase change or induction. As used herein, determining the type of the loaded object by applying the current to the sensing coil 222 may be defined as inductive sensing.

When there is no loaded object near the sensing coil 222 or the loaded object is not a non-inductive object that does not contain an appropriate metal component, the phase value ωt+φ of the alternating current A cos(ωt+φ) received through the sensing coil 222 does not exhibit a large difference (φ) from the phase value ωt of the alternating current before being applied to the sensing coil 222. This relative lack of a phase change may be interpreted to mean that the inductance value L of the sensing coil 222 does not change much since (1) there is no loaded object near the sensing coil 222, or (2) the loaded object does not contain an appropriate metal component and is, thus, non-inductive.

However, if the loaded object in proximity to the sensing coil 222 contains an appropriate metal that is inductive (e.g., includes iron, nickel, cobalt, and/or some alloys of rare earth metals), magnetic and electrical inductive phenomena occur between the loaded object and the sensing coil 222. Therefore, a relatively large change may occur in the inductance value L of the sensing coil 222. Thus, the change in the inductance value L may greatly increase a change φ of the phase value ωt+φ of the alternating current A cos(ωt+φ) received through the sensing coil 222.

Accordingly, the control unit 602 may apply the alternating current A cos(ωt) having a predetermined amplitude A and phase value ωt to the sensing coil 222 of the loaded-object sensor and, then, determine the type of the loaded object close to the working coil 222 based on an attributed of the applied input alternating current and the received output current from the sensing coil 222. In one embodiment of the present disclosure, the control unit 602 may apply the alternating current A cos(ωt) having a predetermined amplitude A and phase value ωt to the sensing coil 222 of the loaded-object sensor 220, the AC current received through the sensing coil 222 may become the alternating current A cos(ωt+φ) with the phase value ωt+φ. In this context, when the phase change φ for the alternating current A cos(ωt+φ) exceeds a predetermined first reference value, the control unit 602 may determine that the loaded object has an induction heating property. Alternatively, when the phase change φ of the alternating current A cos(ωt+φ) does not exceed the predetermined first reference value, the control unit 602 may determine that the loaded object does not have an induction heating property or no object is positioned on the loading plate 106.

In another embodiment of the present disclosure, the control unit 602 may apply the alternating current A cos(ωt) having a predetermined amplitude A and phase value ωt to the sensing coil 222 of the loaded-object sensor, the control unit may measure an inductance value L of the sensing coil 222. When the measured inductance value L of the sensing coil 222 exceeds a predetermined second reference value, the control unit 602 may determine that the loaded object has an inductive heating property. In this connection, when the measured inductance value L of the sensing coil 222 does not exceed the predetermined second reference value, the control unit 602 may determine that the loaded object does not have an inductive heating property or no object may be provided on the loading plate 106.

In this way, when the control unit 602 determines that an object (e.g., cooking vessel) is placed on the loading plate 106 and the loaded object has an inductive heating property, the control unit 602 may perform a heating operation by applying an electric current to the working coils 202, 204 based on, for example, a heating level designated by the user through the interface 114.

During the heating operation, the control unit 602 may measure the temperature of the object being currently heated using the temperature sensor housed within the loaded-object sensor. When controlling the current applied to the working coils 202, 204, the control unit 602 may, for example, apply a particular current level based on the heating level selected by the user when the control unit 602 determined, based on the loaded object sensor 220, that a cooking vessel in positioned on the working coils 202, 204 and has an appropriate induction heating characteristics. The control unit 602 may then determine the temperature of the cooking vessel using the temperature sensor 230 and may modify or stop the current to the working coils 202, 204 based on the detected temperature and the selected heating level, such as to reduce or cease the current when the detected temperature of the cooking vessel equals or exceeds the selected heating level. Similarly, the control unit 602 may determine based on, for example, an attribute of a received current from the sensing coil 222 of the loaded object sensor 220, when the cooking vessel is removed from the working coils 202, 204, and may stop the current to the working coils 202, 204.

When the loaded object sensing is performed using the loaded-object sensor 220 according to the present disclosure, the power supplied to the sensing coil 222 for the loaded object sense may typically be less than 1 W since the sensing coil 222 may be relatively small and generates a relatively small magnetic field. The magnitude of this power for the sensing coil 222 may be very small compared to the power conventionally supplied to the working coil of the working coil assembly 108, 110 (over 200 W) when sensing a presence and composition of loaded object sense.

In one embodiment of the present disclosure, the control unit 602 may be programmed to apply repeatedly the alternating current to the sensing coil 222 at a particular time interval (e.g., 1 second, 0.5 second, or other interval) to determine whether a loaded object on the induction heating device 10 has an inductive heating property (e.g., has an appropriate material and physical shape to be heated by flux from a generated inductive magnetic field). The control unit 602 may analyze the resulting output current (e.g., the phase and/or induction changes) to determine a presence and composition of the loaded object. When the control unit 602 performs such repetitive current application and output current analysis, the type and presence of the loaded object may be determined in near real time (e.g., within the testing interval) by the control unit 602 whenever the user places the object on or removes the object from the induction heating device 10 after the power is applied to the induction heating device 10.

Figure 7:
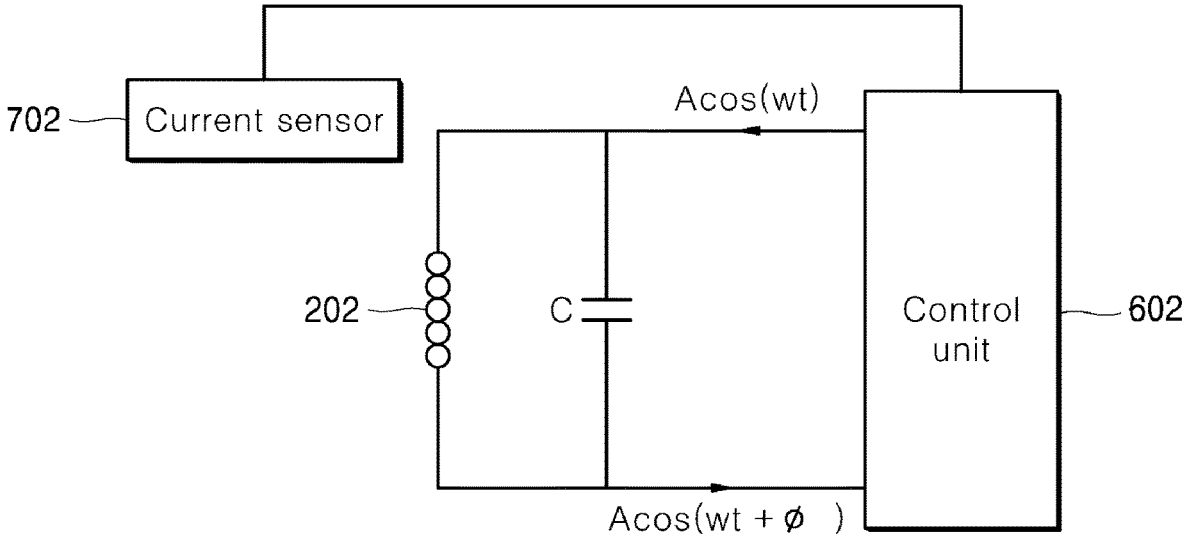
FIG. 7 is a circuit diagram illustrating a current sensing process using a working coil in one embodiment of the present disclosure.

FIG. 7 is a circuit diagram illustrating a current sensing process using a working coil in one embodiment of the present disclosure. Referring to FIG. 7, the control unit 602 may apply an alternating current A cos(ωt) having a predetermined amplitude A and phase value ωt to the working coil 202.

If the loaded object that is close to the working coil 202 has an inductive heating property, such as including at least a layer of an appropriate metal at a position near (e.g., at least partially within an inductive field formed by the sensing coil 222), the alternating current A cos(ωt) applied to the working coil 202 may cause magnetic and electric inductive phenomena between the loaded object and the working coil 202. Accordingly, an eddy current may occur in the loaded object. In this situation, the eddy current magnitude around the working coil 202 may increase.

However, when there is no loaded object proximate to the working coil 202 (e.g., at least partially within an inductive field formed by the sensing coil 222), or the loaded object is a non-inductive and does not contain an appropriate metal component, the magnetic and electric inductive phenomenon between the loaded object and the working coil 202 does not occur. As a result, the eddy current magnitude around the working coil 202 does not increase.

Accordingly, after the control unit 702 applies the alternating current A cos(ωt) to the working coil 202, the control unit 702 may measure the magnitude of the eddy current occurring around the working coil 202 via a current sensor 702. When the magnitude of the measured eddy current exceeds a predetermined third reference value, the control unit 702 may determine that the loaded object has an inductive heating property and can be heated by the inductive heating device. In the present disclosure, determining the type of the loaded object based on the magnitude of the eddy current occurring in the loaded object when the current is applied to the working coil 202, as described above, may be defined as "current sensing." In one embodiment, the control unit 702 may apply repeatedly the alternating current to the working coil 202, 204 at a particular time interval (e.g., 1 second, 0.5 second, or other interval) to use the current sensing to identify when the loaded object is removed from the loading plate 106.

Figure 8:
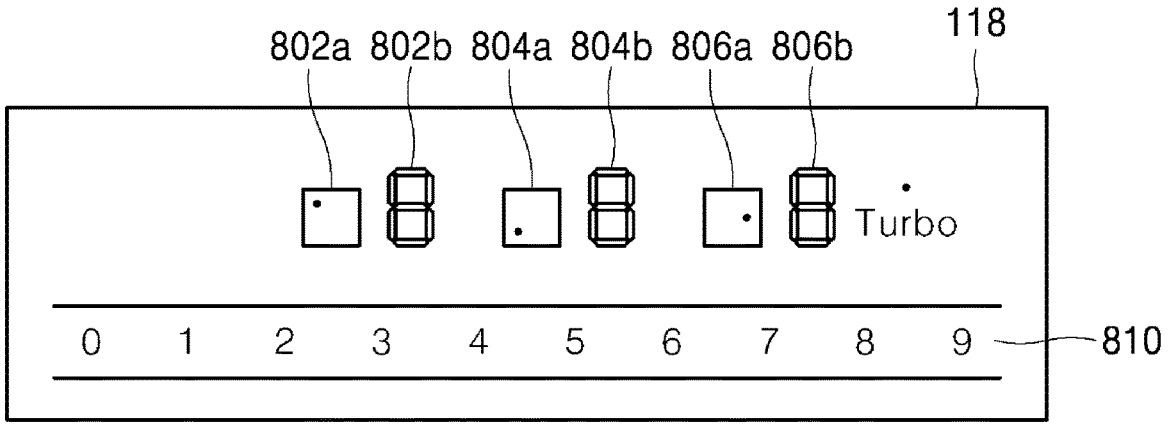
FIG. 8 shows a manipulation region of the inductively-heated device according to one embodiment of the present disclosure.

FIG. 8 shows the manipulation region 118 located in the loading plate 106 of FIG. 1 according to one implementation. As shown in FIG. 8, the manipulation region 118 may include heating-region selection buttons 802*a*, 804*a*, and 806*a* that may respectively indicate positions of heating-regions included in the induction heating device. The manipulation region 118 may include a heating power selection button 810 that controls the heating power of (e.g., the induction current applied to working coils) each heating region. In FIG. 8, information about the three heating-regions may be displayed in the manipulation region 118, but the present disclosure is not limited thereto. The number of heating-regions included in the induction heating device may vary depending on different embodiments.

Further, current heating powers of the corresponding heating-regions may be respectively indicated by corresponding numbers in heating power display regions 802*b*, 804*b*, and 806*b*. Further, the manipulation region 118 may include a turbo display region (not shown) that indicates a state in which a particular heating-region is performing rapid heating.

The user may place the loaded-object on one of the three heating-regions, and the following discussion provides an example in which the user places a cooking vessel in the second heating-region. The user may then touch the second heating-region selection button 804*a*. The user may then submit an input identifying the heating power to be applied to the loaded-object placed on the corresponding heating-region via the touch of the heating power selection button 810. The induction heating device then determines whether the loaded-object on the second heating-region selected by the user has an inductive heating property, such as using the loaded-object sensor 220 described above. When the corresponding loaded-object has an inductive heating property, the inductive heating device 10 may apply a current to a working coil corresponding to a corresponding heating-region to perform a heating operation to reach the heating power designated by the user.

In this context, when the loaded-object placed in the second heating-region has an inductive heating property, the heating power input by the user through the heating power selection button 810 may be displayed as a number in the heating power display region 804*b* corresponding to the second heating-region. Conversely, when the loaded-object placed in the second heating-region does not have the above inductive heating property, the heating power display region 804*b* corresponding to the second heating-region may be marked with a number or letter (e.g., displaying a letter "u") to indicate that the corresponding loaded-object is not compatible with non-inductive heating (e.g., does not have the inductive heating property.

After the user places the loaded-object in a certain heating-region, the user may specify the specific heating region to be heated via the touch of the loaded-object selection button. However, as described above, according to the present disclosure, a current may be applied to the sensing coil 222 of the loaded-object sensor repeatedly at a predetermined time interval, and, thus, the type of the loaded-object may be determined based on the result of the current application. In this case, when the user places the loaded-object in any heating-region, the type of the loaded-object may be determined substantially immediately after the predetermined time interval elapses. For example, when the user places the object with inductive heating properties on the second heating-region, the induction heating device may not wait for the user to input the heating-region selection buttons 802*a*, 804*a*, or 806*a*, but instead, may indicate that the second heating-region is available to heat the cooking vessel on the heating power display region 804*b* corresponding to the second heating-region using a character or number (e.g., 0).

When such a letter or number is displayed, the user may input a heating power to be applied to the corresponding heating-region via the touch of the heating power selection button 810. Then, the heating power input may be displayed in the heating power display region 804*b*. The induction heating device 10 then applies a current to the working coil 202, 204 so that the heating power of the corresponding heating-region reaches the heating power level associated with the input by the user.

When the user places a non-inductive heating loaded-object on the second heating-region, a number or letter (e.g., u) to indicate that the corresponding loaded-object is a non-inductive heated loaded-object or is not correctly positioned with respect to the working coil 202, 204, according to the loaded-object determination process as described above, may be displayed in the heating power display region 804*b* corresponding to the second heating-region.

According to the present disclosure, after the user places an object with inductive heating properties on any heating-region, the user may enter a desired heating power and start the heating operation without having to press the heating-region selection button 802*a*, 804*a*, or 806*a*. That is, the induction heating device 10 according to certain embodiments of the present disclosure may eliminate the input operation for selecting the heating region from the user.

Further, according to the present disclosure, when the user places a loaded object on any heating-region, the device may display, on each heating power display region, within a relatively short period of time, whether the corresponding loaded object has an inductive heating property. Therefore, the user may intuitively and quickly check the type of the loaded object.

Figure 9:
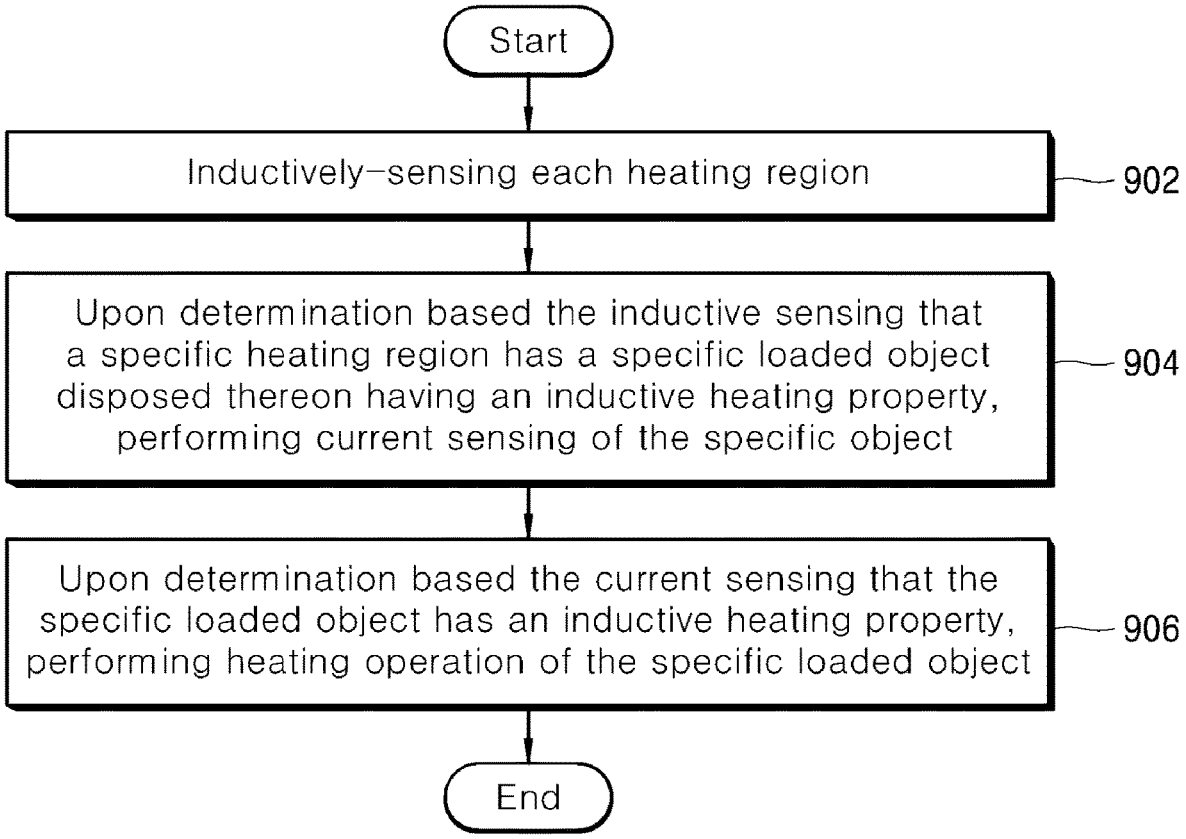
FIG. 9 is a flow chart of a method for controlling an induction heating device according to one embodiment of the present disclosure.

Hereinafter, a method for controlling an induction heating device according to the present disclosure using current sensing and inductive sensing will be described in detail. FIG. 9 is a flow chart of a method for controlling an induction heating device according to one embodiment of the present disclosure.

Referring to FIG. 9, the control unit 602 may first perform inductive sensing of one or more heating-regions in the loading plate 106 of the induction heating device (step 902). In one embodiment of the present disclosure, the control unit 602 may repeatedly perform the inductive sensing of all heating-regions in the loading plate 106 at a predetermined sensing interval (e.g., 0.5 seconds or 1 second).

If it is determined from the inductive sensing that the loaded object placed in any heating-region has an inductive heating property, the control unit 602 may perform current sensing of the loaded object placed in the corresponding heating-region (step 904). That is, the control unit 602 may first determine the type of the loaded object via the inductive sensing, and then, the control unit 602 may perform the current sensing of the loaded object determined to have the inductive heating property.

Thus, when it is determined by the current sensing that the loaded object placed in the corresponding heating-region has an inductive heating property, the control unit 602 may perform a heating operation of the corresponding loaded object (operation 906). For example, the control unit 602 may determine from inductive sensing and subsequent current sensing that the second heating region has an optimal inductive heating property. Thus, the control unit 602 may allow the heating power display region 804*b* of FIG. 8 corresponding to the second heating-region to display a letter or number (e.g., number 0) indicating that the corresponding second heating-region is available.

When the letter or number is displayed, the user may input a heating power to be applied to the corresponding heating region via a touch of the heating power selection button 810. The input heating power is then be displayed in the heating power display region 804*b*. Afterwards, the induction heating device 10 may perform the heating operation by applying current to the working coil corresponding to the second heating-region so that the heating power of the second heating-region reaches the heating power input by the user.

The inductive sensing as described above may use less power compared to the current sensing to detect whether the loaded object has the inductive heating property. However, the accuracy of the inductive sensing may not be guaranteed due to a sudden change in temperature around the coil or other environmental factors, or the generation of noise. Thus, according to the present disclosure, if it is first determined from the inductive sensing that the loaded object has the inductive heating property, then, the current sensing may confirm that the determination from the inductive sensing is correct. This allows whether the loaded object has the inductive heating property to be determined more reliably.

Meanwhile, although not shown in FIG. 9, in the control method according to the present disclosure, when power is first applied to the present device, current sensing of all heating regions on which objects are loaded may be first performed. When it is determined from the current sensing result that a specific loaded object has the inductive heating property, a heating operation may be performed on the specific loaded object. The number of times the current sensing is performed when the power is first applied to the device may vary according to the embodiment.

For example, the current sensing of all heating-regions may be performed once at the time when the power is applied to the induction heating device. It is thus determined which of loaded objects corresponding to the heating-regions have inductive heating properties. When it is determined from this initial current sensing result that a specific one of the loaded objects has an inductive heating property, the heating operation of the specific object may be performed substantially immediately. Otherwise, when it is determined from the initial current sensing result that there are no objects with the inductive heating property, the subsequent periodic inductive sensing as described above may be performed to identify the objects with the inductive heating property.

Figure 10:
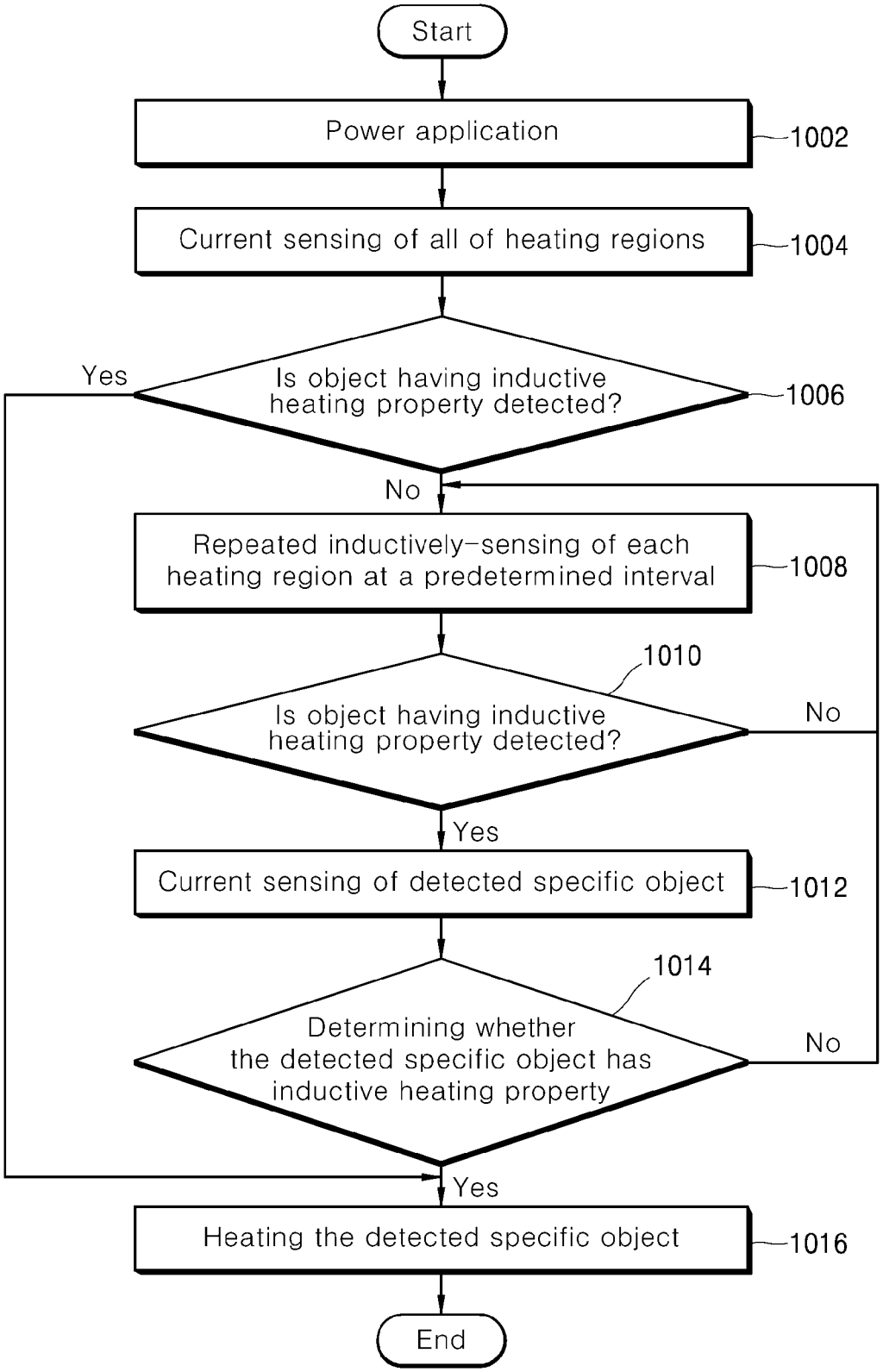
FIG. 10 is a flow chart of a method for controlling an induction heating device according to another embodiment of the present disclosure.

FIG. 10 is a flow chart of a method for controlling an induction heating device according to another embodiment of the present disclosure. Referring to FIG. 10, power may be applied to the induction heating device 10 based on an input by the user, and, thus, operation of the induction heating device may start (step 1002). Then, the control unit 602 performs current sensing by applying an alternating current having a predetermined amplitude and phase value to each of the working coils 202, 204 corresponding to all the heating-regions existing in the induction heating device (step 1004).

The control unit 602 may determine from the initial current sensing result in step 1004 whether the object lying on any heating-region has an inductive heating property (step 1006). If it may be determined from the above determination result that an object placed in an arbitrary heating-region has an inductive heating property, then, the control unit 602 may perform a heating operation of the heating region corresponding to the object as determined to have the inductive heating property (step 1006).

For example, the control unit 602 may determine from the determination at operation 1006 that the object corresponding to the second heating region has an inductive heating property. In this situation, the heating power display region corresponding to the second heating region may indicate a letter or a number (e.g., 0) indicating that the corresponding heating-region may be available. When the letter or number is displayed, the user may input a heating power to be applied to the corresponding second heating region via a touch of the heating power selection button. The input heating power may then be displayed in the heating power display region. Thereafter, the control unit 602 may apply a current to the working coil 202, 204 to perform a heating operation such that the heating power of the heating region corresponding to the loaded object reaches the heating power inputted by the user.

If it is determined from the determination at step 1006 that none of the objects corresponding to the heating-regions have the inductive heating property, the control unit 602 may repeatedly perform inductive sensing of all the heating regions at a predetermined sensing interval (step 1008). For example, the control unit 602 may perform inductive sensing by applying an alternating current to the sensing coil 222 of a loaded-object sensor 220 provided in the central region of the working coil 202, 204 corresponding to each heating-region every 0.5 seconds.

The control unit 602 may determine from the inductive sensing result at step 1008 which of the objects on the heating-regions have the inductive heating property (step 1010). If it may be determined from the determination result in step 1010 that a specific object corresponding to the specific heating-region has the inductive heating property, the control unit 602 may perform current sensing of the heating region corresponding to the specific object as determined to have the inductive heating property (step 1012). As described above, the accuracy of the inductive sensing may vary to changes in the temperature around the coil or other environmental factors, or the generation of noise. Thus, according to the present disclosure, the control unit 602 may first determine from the inductive sensing whether the loaded object has the inductive heating property, and then, the control unit 602 may perform the current sensing to confirm that the determination from the inductive sensing is correct. This process allows the determination of whether the loaded object has the inductive heating property to be performed more reliably.

The control unit 602 may determine from the current sensing result at step 1012 whether the loaded object as determined to have the inductive heating property from inductive sensing at step 1008 has an inductive heating property (step 1014). If it is determined from the determination result in step 1014 that the loaded object, which was initially determined to have the inductive heating property from inductive sensing at operation 1008, actually does not have the inductive heating property, the control unit 602 may return to step 1008 and may again perform periodic inductive sensing of one or more of the heating-regions.

However, if it is determined from the determination result in step 1014 that the loaded object, initially determined to have the inductive heating property from inductive sensing at operation 1008, actually has the inductive heating property based on the current sensing, then the control unit 602 may perform a heating operation of the heating region corresponding to the object (step 1016). For example, the control unit 602 may determine from the determination at step 1014 that the object positioned at the second heating region has an inductive heating property. In this situation, the heating power display region corresponding to the second heating region may indicate a letter or a number (e.g., 0) indicating that the corresponding heating-region may be available. When the letter or number is displayed, the user may submit an input identifying a heating power to be applied to the corresponding second heating region via a touch of the heating power selection button. The input heating power may then be displayed in the heating power display region. Thereafter, the control unit 602 may apply a current to the working coil to perform a heating operation such that the heating power of the heating region corresponding to the object reaches the heating power input by the user.

Eventually, according to the present disclosure, the sensing process performed by the operation 1004 to the operation 1006 or the sensing process performed by the operation 1008 to the operation 1014 may allow the control unit to better determine whether the loaded object has the inductive heating property substantially immediately after the user loads an object on the loading plate of the heating device. This determination result may be intuitively provided to the user in the heating power display region shown in FIG. 8. Therefore, when the loaded object is placed on the loading plate after powering the induction heating device, the user may quickly and easily check the type of the loaded object to determine whether the object is compatible with induction heating.

Furthermore, according to the present disclosure, the loaded object having the inductive heating property may be automatically recognized by the sensing process as described above. Thus, the inductive heating device may be activated without the user performing an operation of pressing a heating-region selection button. Accordingly, there is an advantage that convenience for the user may be significantly increased.

The aspects of present disclosure provide an induction heating device capable of accurately and quickly discriminating the type of the loaded object while consuming less power than a conventional one, and to provide a method for controlling the induction heating device. Further, aspects of the present disclosure provide an induction heating device configured to simultaneously perform temperature measurement of the loaded object and determination of the type of the loaded object, and to provide a method for controlling the induction heating device.

Furthermore, aspects of the present disclosure provide an induction heating device whereby the user may quickly and intuitively check whether the corresponding loaded object has the inductive heating property, and the user may skip the operation of pressing a heating-region selection button when the user loads the loaded object, and further provide a method for controlling the induction heating device.

The aspects of the present disclosure are not limited to the above-mentioned aspects. Other aspects of the present disclosure, as not mentioned above, may be understood from the foregoing descriptions and more clearly understood from the embodiments of the present disclosure. Further, it will be readily appreciated that the aspects of the present disclosure may be realized by features and combinations thereof as disclosed in the claims.

The aspects of present disclosure provide an induction heating device with a new loaded-object sensor for accurately determining a type of the loaded object while consuming less power in comparison to other induction heating appliances. The loaded-object sensor according to the present disclosure may have a cylindrical hollow body with a sensing coil wound on an outer face thereof. Further, a temperature sensor may be accommodated in a receiving space formed inside the body of the loaded-object sensor.

The loaded-object sensor having such a configuration may provided in a central region of the working coil and concentrically with the coil. The sensor may determine the type of loaded object placed at the corresponding position to the working coil and at the same time, measure the temperature of the loaded object.

The sensing coil included in the loaded-object sensor according to the present disclosure may have fewer rotation counts and a smaller total length than the working coil. Accordingly, the sensor according to the present disclosure may identify the type of the loaded object while consuming less power as compared with the discrimination method of the loaded object using the working coil.

Further, as described above, the temperature sensor may be accommodated in the internal space of the loaded-object sensor according to the present disclosure. Accordingly, the temperature may be measured, and the type of the loaded object may be determined at the same time by using the sensor having a relatively smaller size and volume.

In accordance with aspects of the present disclosure, a combination of current sensing using the working coil and inductive sensing using the loaded object sensor may allow accurately and quickly discriminating the type of the loaded object. In this connection, the inductive sensing may consume less power than the current sensing. In accordance with the present disclosure, first, the inductive sensing may be periodically performed after power may be applied to the induction heating device, to detect a specific object with inductive heating property. Next, the current sensing of the specific object having the inductive heating property may be performed to verify whether the specific object has the inductive heating property. Thus, when the user simply places the loaded object on the loading plate of the induction heating device, the device may allow the user to quickly and intuitively confirm whether the corresponding loaded object has the inductive heating property. Thus, an operation of pressing the heating-region selection button by the user after loading the loaded object may be omitted.

In accordance with a first aspect of the present disclosure, an induction heating device may comprise: a loading plate on which a loaded object may be placed, wherein the loading plate may have at least one heating region; at least one working coil provided below the loading plate for heating a corresponding loaded object using inductive current, wherein each working coil may correspond to one of the heating regions; a loaded-object sensor provided concentrically with each working coil, wherein the sensor includes a sensing coil, wherein each working coil surrounds each sensor; and a control unit configured to determine whether a loaded object placed on a corresponding heating region has an inductive heating property via at least one of current sensing using a corresponding working coil, and inductive sensing using a corresponding loaded-object sensor.

In one embodiment of the device, the at least one heating region includes a plurality of heating regions, wherein the control unit may be configured to repeatedly perform the inductive sensing of all of the heating-regions at a predetermined sensing interval. In one embodiment of the device, upon determination from the inductive sensing result that a corresponding loaded object is determined to have the inductive heating property, the control unit may be configured to perform the current sensing of the corresponding loaded object using a corresponding working coil.

In one embodiment of the device, the at least one heating region may include a plurality of heating regions, wherein the control unit may be configured to perform the current sensing of all of the heating-regions upon an initial application of power to the device. In one embodiment of the device, the control unit may be configured to allow a corresponding working coil to perform heating operation of a corresponding loaded object only when said corresponding loaded object is determined, from the current sensing result, to have the inductive heating property.

In one embodiment of the device, when a magnitude of eddy current generated in a corresponding loaded object in the current sensing when current is applied to a corresponding working coil exceeds a first predetermined reference value, the control unit may be configured to determine that the corresponding loaded object has an inductive heating property. In one embodiment of the device, when a phase value of current measured in a corresponding sensing coil in the inductive sensing when current is applied to the corresponding sensing coil exceeds a second predetermined reference value, the control unit may be configured to determine that a corresponding loaded object has an inductive heating property.

In one embodiment of the device, when an inductance value measured in a corresponding sensing coil in the inductive sensing when current is applied to the corresponding sensing coil exceeds a third predetermined reference value, the control unit may be configured to determine that a corresponding loaded object has an inductive heating property. In one embodiment of the device, a consumed power amount for the inductive sensing may be smaller than a consumed power amount for the current sensing.

In accordance with a second aspect of the present disclosure, there may be provided a method for controlling an induction heating device, wherein the device has at least one heating region, wherein each heating region corresponds to each loaded object provided thereon; wherein the method may comprise: inductively-sensing each heating region; upon determination based the inductive sensing that a specific loaded object provided on a specific heating region has an inductive heating property, performing current sensing of the specific heating region; and upon determination based the current sensing that the specific loaded object has an inductive heating property, performing heating operation of the specific loaded object.

In one embodiment of the method, the at least one heating region includes a plurality of heating regions, wherein the method may further comprise: performing initial current sensing of all of the heating-regions upon an initial application of power to the device; determining based the initial current sensing whether each loaded object provided on each heating region has an inductive heating property; and performing heating operation of a loaded object determined to have the inductive heating property. In one embodiment of the method, inductively-sensing of each heating region may be repeated at a predetermined interval.

In accordance with aspects of the present disclosure, the induction heating device and the method for controlling the same may be capable of accurately and quickly discriminating the type of the loaded object while consuming less power than a conventional one. Further, in accordance with aspects of the present disclosure, the induction heating device and the method for controlling the same may simultaneously perform temperature measurement of the loaded object and determination of the type of the loaded object. Furthermore, the induction heating device and the method for controlling the same may allow the user to quickly and intuitively check whether the corresponding loaded object has the inductive heating property, and may allow user to skip the operation of pressing a heating-region selection button when the user loads the loaded object.

In the above description, numerous specific details are set forth in order to provide a thorough understanding of the present disclosure. The present disclosure may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heating device comprising:

a loading plate having one or more heating regions;

one or more working coils provided below the loading plate, the working coils corresponding to, respectively, the heating regions;

one or more sensing coils, each of the sensing coils being provided concentrically with and surrounded by respective ones of the working coils; and a controller to determine whether a cooking vessel positioned on one of the heating regions has an inductive heating property via at least one of current sensing using one of the working coils corresponding to the heating region for the cooking vessel, or inductive sensing using one of the sensing coils corresponding to the one of the working coils, wherein the controller is configured to repeatedly perform the inductive sensing in each of the heating regions at a prescribed sensing interval, and upon determining from the inductive sensing that the cooking vessel having the inductive heating property is positioned on the heating region, the controller is configured to perform the current sensing of the cooking vessel using the working coil corresponding to the heating region on which the cooking vessel is placed, wherein only upon determination that the cooking vessel having the inductive heating property is positioned on the heating region from the inductive sensing and the current sensing, the controller is configured to perform a heating operation of the cooking vessel by the corresponding working coil, wherein an amount of consumed power for the inductive sensing is set to be less than an amount of consumed power amount for the current sensing, wherein the controller is configured to determine whether or not the loaded object has inductive heating property based on at least one of an inductance value or a current phase of the sensing coil when a current is applied to the sensing coil, and wherein the controller is configured to determine whether or not the loaded object has inductive heating property based on a magnitude of eddy current of the working coil when a current is applied to the working coil.

2. The induction heating device of claim 1, wherein the one or more heating regions includes a plurality of heating regions, and wherein the controller is further to perform the current sensing at all of the heating regions when the induction heating device is initially activated.

3. The induction heating device of claim 1, wherein the controller, when determining whether the cooking vessel has the inductive heating property using the current sensing, is further to:

apply the current to the working coil, and when the magnitude of eddy current generated in the cooking vessel while the current is applied to the working coil exceeds a reference value, determine that the cooking vessel has the inductive heating property.

4. The induction heating device of claim 1, wherein the controller, when determining whether the cooking vessel has the inductive heating property using the induction sensing, is further to:

apply the current to the sensing coil, and when a phase change of the current applied to the sensing coil exceeds a reference value, determine that the cooking vessel has the inductive heating property.

5. The induction heating device of claim 1, wherein the controller, when determining whether the cooking vessel has the inductive heating property using the induction sensing, is further to:

apply the current to the sensing coil, and when the inductance value measured in the sensing coil when the current is applied to the sensing coil exceeds a reference value, determine that the cooking vessel has the inductive heating property.

6. The induction heating device of claim 1, further comprising:

a display to provide an indication of whether the cooking vessel has the inductive heating property.

7. The induction heating device of claim 6, wherein the display further provides an indication of the corresponding one of the heating areas where the cooking vessel is positioned.

8. The induction heating device of claim 1, further comprising:

a cylindrical body having a first receiving space defined therein; and a cylindrical magnetic core received in the first receiving space, wherein the magnetic core has a second receiving space defined therein, and wherein the sensing coil is wound on an outer face of the body.

9. The induction heating device of claim 8, wherein the sensing coil is wound on the outer face of the body by a first winding count, and the working coil is wound by a second winding count that is greater than the first winding count of the sensing coil.

10. The induction heating device of claim 8, further comprising a temperature sensor received in the second receiving space to detect a temperature of the cooking vessel.

11. The induction heating device of claim 10, wherein the body includes an internal flange to support the magnetic core, the internal flange includes a wire hole defined therein, and a wire connected to the temperature sensor in the second receiving space passes through the wire hole and out of the body.

12. A method for controlling an induction heating device, wherein the method comprises:

performing inductive sensing repeatedly in each of one or more heating regions at a prescribed sensing interval;

when a cooking vessel is determined, based on the inductive sensing, to be provided in one of the heating regions and to have an inductive heating property, performing current sensing of the cooking vessel; and upon verifying based the current sensing that the cooking vessel has the inductive heating property, managing the heating region to perform an inductive heating operation on the cooking vessel, wherein performing the current sensing includes, upon determining from the inductive sensing that the cooking vessel is positioned on the heating region and has the inductive heating property, performing the current sensing using a working coil corresponding to the heating region on which the cooking vessel is positioned, wherein an amount of consumed power for the inductive sensing is set to be less than an amount of consumed power amount for the current sensing, wherein when the inductive sensing is performed, whether or not the loaded object has inductive heating property is determined based on at least one of an inductance value or a current phase of the sensing coil when a current is applied to the sensing coil, and wherein when the current sensing is performed, whether or not the loaded object has inductive heating property is determined based on a magnitude of eddy current of the working coil when a current is applied to the working coil.

13. The method of claim 12, wherein the method further comprises:

performing initial current sensing of all of heating-regions included in the induction heating device;

determining based the initial current sensing whether the cooking vessel has the inductive heating property; and performing the heating operation of the cooking vessel determined to have the inductive heating property.

14. The method of claim 12, further comprising:

displaying an indication of whether the cooking vessel is determined to have the inductive heating property.

15. The method of claim 12, wherein:

the heating region includes a working coil having a first length and a first number of windings, and a sensing coil having a second length that is less than the first length and a second number of windings that is less than the first number of windings, performing the inductive sensing includes providing a first current to the sensing coil, and performing the current sensing includes providing a second current to the working coil.

16. The method of claim 12, wherein managing the heating region to perform the inductive heating operation on the cooking vessel includes:

activating the working coil for the heating region based on both the inductive sensing and the current sensing indicating that the cooking vessel is positioned on the heating region and has the inductive heating property.

17. The method of claim 12, wherein performing the current sensing includes:

apply the current to the working coil; and determining that the cooking vessel is provided in the heating region and has the inductive heating property when the magnitude of eddy current generated in the cooking vessel while the current is applied to the working coil exceeds a reference value.

18. The method of claim 12, when performing the inductive sensing includes:

applying the current to one or more sensing coils provided in the one or more heating regions; and when a phase change of the current applied to one of the sensing coils exceeds a reference value, determine that the cooking vessel is positioned in the heating region and has the inductive heating property.

19. The method of claim 12, when performing the inductive sensing includes:

applying the current to one or more sensing coils provided in the one or more heating regions; and when the inductance value measured in one of the sensing coils when the current is applied to the sensing coil exceeds a reference value, determine that the cooking vessel is positioned in the heating region and has the inductive heating property.

* * * * *